United States Patent [19]

Ikeda et al.

[11] Patent Number: 4,702,146

[45] Date of Patent: Oct. 27, 1987

[54] GAS PRESSURE ADJUSTING DEVICE IN GAS-OPERATED AUTO-LOADING FIREARM

[75] Inventors: Kouhei Ikeda, Miwa; Kozo Iwata, Gifu; Hisayoshi Masaki, Kawage, all of Japan

[73] Assignee: Howa Kogyo Kabushiki Kaisha, Aichi, Japan

[21] Appl. No.: 827,351

[22] Filed: Feb. 7, 1986

[30] Foreign Application Priority Data

Feb. 14, 1985 [JP] Japan ..... 60-27129

[51] Int. Cl.[4] ..... F41D 5/08

[52] U.S. Cl. ..... 89/193

[58] Field of Search ..... 89/193

[56] References Cited

U.S. PATENT DOCUMENTS

| | | | |
|---|---|---|---|
| 785,974 | 3/1905 | McClean | 89/193 |
| 2,987,967 | 6/1961 | Wild et al. | 89/193 |
| 3,020,807 | 2/1962 | Hailston et al. | 89/193 |
| 3,127,812 | 4/1964 | Into et al. | 89/193 |

FOREIGN PATENT DOCUMENTS 50-33358 10/1975 Japan .

*Primary Examiner*—Stephen C. Bentley
*Attorney, Agent, or Firm*—Wenderoth, Lind & Ponack

[57] ABSTRACT

A gas pressure adjusting device in the gas-operated mechanism of a gas-operated autoloading shotgun is in the form of a valve assembly comprising essentially a valve seat encompassing a stepped valve opening consisting of adjacent opening parts of different diameters, a valve body having first and second pressure-receiving surfaces and first and second sliding contact surfaces respectively fitted slideably in the valve opening parts, and a spring urging the valve body toward and into closed state against the valve seat. This valve assembly operates with a double action wherein the gas pressure tapped from the barrel bore acts initially on only the first pressure-receiving surface of the valve body and, upon exceeding a predetermined pressure, moves the valve body past a point where it acts also on the second pressure-receiving surface thereby to be released into the outside air. Thus, a low gas pressure produced by a low-base load is not released and positively operates the breech bolt, while a high pressure produced by a high-base load is partly released to prevent excessive impact on moving parts of the shotgun.

4 Claims, 6 Drawing Figures

GAS PRESSURE ADJUSTING DEVICE IN GAS-OPERATED AUTO-LOADING FIREARM

BACKGROUND OF THE INVENTION

1. Field of the Invention

This invention relates generally to gas-operated automatic-loading firearms and more particularly to a gas pressure adjusting device of a gas-operated mechanism in an automatic-loading shotgun firing ordinary shotshells of 2¾-inch length.

More specifically, the invention relates to a gas pressure adjusting device of the above stated character which automatically adjusts the gas pressure within the actuating cylinder of the gas-operated mechanism responsive to the magnitude of the gas pressure which is generated in the bore at the time of firing of a shotshell and is introduced into the cylinder via a gas port, thereby to cause the gas-operated mechanism to always operate under the most suitable operational conditions even when the load of the shotshell is changed.

2. Description of the Related Art

In a typical automatic shotgun, as will be described more fully hereinafter, when a shotshell is fired, gas under great pressure is generated within the gun bore. A portion of this gas is tapped through a gas port and is introduced into an actuating cylinder of a gas-operated mechanism installed partly within and around a tube magazine that is parallel to and below the gun barrel. This mechanism is driven by the gas to actuate a breech bolt which undergoes a recoiling motion while compressing a recoil spring, which thereafter forces the breech bolt to undergo a counter-recoiling motion to return the breech bolt to its initial state whereat it closes the breech of the chamber. During its recoiling and counter-recoiling motions, the breech bolt carries out the actions of ejecting the empty case of the shotshell which has just been fired, loading the succeeding shotshell in the magazine into the chamber, and cocking the firing mechanism in preparation for the succeeding firing. The above described cycle of operation in a gas-operated auto-loading shotgun is widely known.

The shotshells used in an automatic shotgun operating as described above differ widely, there being not only deviations between individual shotshells but also a wide range of loads from low-base loads of the order of 28 gr to high-base loads of the order of 42 gr. In comparing a low-base load and a high-base load, a great difference exists in the firing gas pressure. Thus the gas-operated mechanism must be capable of operating positively with the gas pressures of all of the above mentioned shotshells. For this reason, in order to prevent malfunctioning with the gas pressure exerted by the minimum low-base load, the gas-operated mechanism is designed with a low-base load as a standard basis.

As a consequence, when a conventional auto-loading shotgun as described above fires a shotshell of high-base load, a tremendous gas pressure is generated, and the above described moving parts are propelled rearward with excessive velocity to produce not only an impact which can cause damage or breakage of the moving parts and shortening of their serviceable life but also a powerful firing reactive impulse, or kickback, which lowers the target scoring accuracy. This has been a problem encountered in the prior art.

A first-stage measure widely resorted to for overcoming or alleviating this difficulty comprises preparing separate barrels each exclusively for a low-base load and for a high-base load, respectively, and restricting the quantity of gas introduced into the cylinder (e.g., by changing the diameter of the gas port) thereby to adjust the gas pressure within the cylinder. Since each barrel in this method is an exclusive-use barrel, positive gas pressure adjustment is achieved. However, this method is inconvenient in that, in the case where the shotgun is fitted with a low-base load barrel, an interchangeable high-base load barrel must be carried as an accessory if there is a possibility of the shotgun being used for high-base load when hunting or target shooting. Furthermore, even when an interchangeable barrel is readily available, the shotgun lacks instantaneous responsiveness to fleeting chances or "targets of opportunity", whereby it is not desirable in actual practice.

With the aim of overcoming the inadequacy of the above described first-stage measure, there has been proposed and reduced to practical use a device comprising a pressure-regulating piston provided within the cylinder and an elastic member such as a spring or a piece of rubber for backing up the piston, which is activated to undergo forward-rearward movement in response to the magnitude of the gas pressure introduced into the cylinder to vary the internal volume of the cylinder and thereby to regulate the gas pressure, as described in the specification of Japansee Pat. No. 821390. However, while the gas pressure regulation according to this device is effective for variations of gas pressure within a limited range, it cannot cope with gas pressure variations within the entire range of gas pressures from a low-base load to a high-base load.

In order to overcome the limitation of the above described second-stage measure, devices as disclosed in U.S. Pat. Nos. 3,020,807 and 3,127,812 and that which we have practically applied to a number of automatic shotguns, as illustrated in FIG. 6 of the accompanying drawings and as described hereinafter, have been proposed as third-stage measures. In each of these third-stage devices, a pressure-adjusting valve is provided within the cylinder, and, when the gas pressure within the cylinder becomes higher than a specific pressure, the pressure-adjusting valve is activated to open the valve opening and discharge the excessive gas to the outside air, thereby adjusting the gas pressure acting in the cylinder.

For a third-stage device, in which the gas pressure within the cylinder is adjusted by discharging surplus gas to the outside by means of a pressure-adjusting valve as described above, to be fully satisfactory, it must satisfy all of the following four necessary and desired conditions.

(1) When a low-base load shotshell is fired, the device must never operate, that is, the valve body must not open the valve opening. If the valve opens and discharges gas when a low-base load shotshell is fired, the gas pressure acting on the piston will be insufficient, whereby malfunctioning of the gas-operated mechanism will occur.

(2) The operational response of the pressure-adjusting device must be prompt and positive. The time elapsing from percussion, firing, and acting of the resulting gas pressure on the piston to completion of recoiling of the breech bolt is a very short time, ordinarily being of the order of 0.02 to 0.03 second. If the gas pressure adjustment is not accomplished within an even shorter time than this, an excessive gas pressure will act on the piston, whereby one of the objects of the device will not be achieved.

(3) The masses of the moving parts of the device must be kept as small as possible. If the masses of the moving parts are large, it will become impossible to satisfy the above condition (2).

(4) The gas discharge hole or holes, i.e., the valve opening, must be made as large as possible so that the required quantity of the gas will be discharged instantaneously.

As set forth in condition (2) above, the specific quantity of gas must be discharged through the opened valve opening within a very short time, and if this is not accomplished, satisfactory pressure adjustment cannot be expected.

As will be discribed in greater detail hereinafter, the conventional gas pressure adjusting devices, even third-stage devices, in shotguns of the instant type do not fully satisfy the conditions set forth above. For example, one problem is that a great spring force is necessary, and another is that the masses of the valve body and the spring tend to be large, whereby the above conditions (2) and (3) cannot be met. Another difficulty is encountered in the structural design of a partition wall constituting the valve seat with one or more valve opening to operate cooperatively with the valve body, the difficulty being in providing sufficient mechanical strength to the partition wall, whereby the above condition (4) cannot be fully satisfied. The above mentioned large spring force further causes great difficulty in the work of assembling the related parts.

SUMMARY OF THE INVENTION

Seeking to overcome the above described problems and other difficulties as will be described hereinafter, this invention provides, in a gas-operated auto-loading shotgun, a gas pressure adjusting device comprising a valve body in the form having a a hollow cylinder of small mass and having first and second pressure-receiving surfaces, a guide rod on which the valve body is slideably fitted, a partition wall having a relatively large valve opening with a large-diameter part and a small-diameter part and constituting a valve seat at its rim part around the valve opening, and a spring for continually biasing the valve body toward the valve seat, whereby the valve opening is normally closed by the rear end surfaces of the valve body and the guide rod.

The valve body and the valve seat have a mutual configuration whereby the gas pressure initially acts on only the first pressure-receiving surface and, if exceeding a predetermined pressure, forces the valve body away from the valve seat against the force of the spring to a position where the gas pressure also on the second pressure-receiving surface to fully open the valve opening so as to abruptly release the gas pressure into the outside air. As a result, a relatively low gas pressure produced by the firing of a low-base load shell is not released and is ample for positively actuating the breech bolt in its automatic operations, while a high gas pressure produced by a high-base load shell is partly released to prevent excessive impact from being applied to the affected moving parts of the shotgun.

The nature, utility, and further features of this invention will be more clearly apparent from the following detailed description when read in conjunction with the accompanying drawing, briefly described below.

DETAILED DESCRIPTION OF THE INVENTION

As conducive to a full understanding of this invention, a general description of a conventional gas-operated auto-loading shotgun, attendant problems, and limitations thereof will first be set forth.

Figure 4:
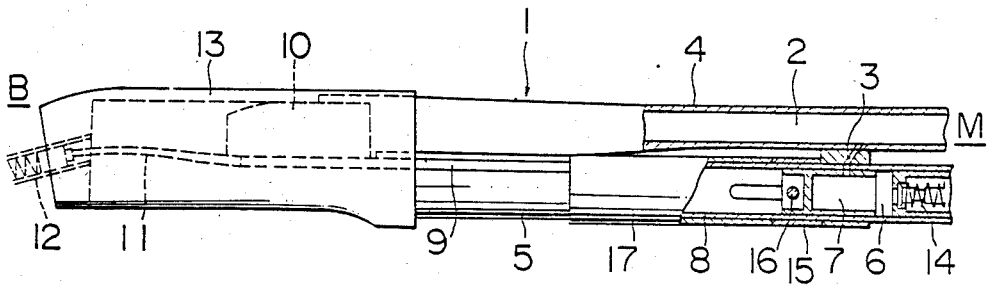
FIG. 4 is a right side elevational view cut away shown in vertical section, showing the rear portion of the barrel, the receiver part, and the gas operated mechanism of a typical example of a gas-operated auto-loading shotgun.

Referring first to FIG. 4 showing the gas-operated mechanism of a typical example of an automatic shotgun 1, when a shotshell (not shown) is fired, gas under great pressure is generated by the firing within the bore 2. A portion of this gas is tapped through a gas port 3 and introduced into an actuating cylinder 6 formed at the front or muzzle end of a tube magazine 5 provided parallelly to and below the barrel 4. The pressure of this gas acts on a piston 7 that is slidably fitted in the cylinder 6 and the pressure forces the piston to move rearward at a high velocity and moreover abruptly. Consequently, a rearward impact force is imparted to a sleeve 17 and is transmitted therefrom and by way of a slider 9 to a breech bolt 10, which is connected to the sleeve 17 by the slider 9 and, at the time of firing, has been closing the breech end of the bore 2. The breech bolt 10 thereby recoils rearward within a receiver 13, compressing a recoil spring 12 by way of a link bar 11, and thus opens the breech of the bore 2.

When the breech bolt 10 has completed it recoil stroke, it undergoes a counter recoil, being pushed forward by the recoil spring 12, and again closes the breech. As a natural consequence, the sleeve 17 and the piston 7 return to their original positions. In the period during which the breech bolt undergoes its recoiling and counter-recoiling motions, it carries out the actions of ejecting the empty case of the shotshell which has just been fired, loading the succeeding shotshell in the magazine into the chamber, and cocking the firing mechanism (all not shown). The above described one cycle of operation in an auto-loading shotgun 1 utilizing gas pressure is widely known.

An example of the known devices of the aforementioned third-stage measure will now be described with reference to FIG. 6. A cylinder 6 is provided in the muzzle end of a tube magazine 5 provided below and parallel to the barrel 4, and a piston 7 is slidably fitted within the cylinder 6. The interior of the cylinder 6 and the bore 2 communicative through a gas port 3. Furthermore, a connecting ring 15 slidably fitted around the outer peripheral surface of the tube magazine 5 is pin coupled to the piston 7 by a pin 16 passed through longitudinal slots in the tube magazine 5. A sleeve 17 fitted around the tube magazine 5, similarly as the connecting ring 15, is in abutting contact with the connecting ring 15 and is coupled by way of a slider to the breech bolt (both not shown in FIG. 6).

Thus, the breech bolt is caused to undergo recoil motion by the gas pressure introduced through the gas port 3 into the cylinder 6 and thereafter is caused to undergo counterrecoil motion by the recoil spring (not shown). The above described construction and operation of the gas-operated mechanism are the same as those of the general example of the mechanism described hereinbefore with reference to FIG. 4.

Figure 6:
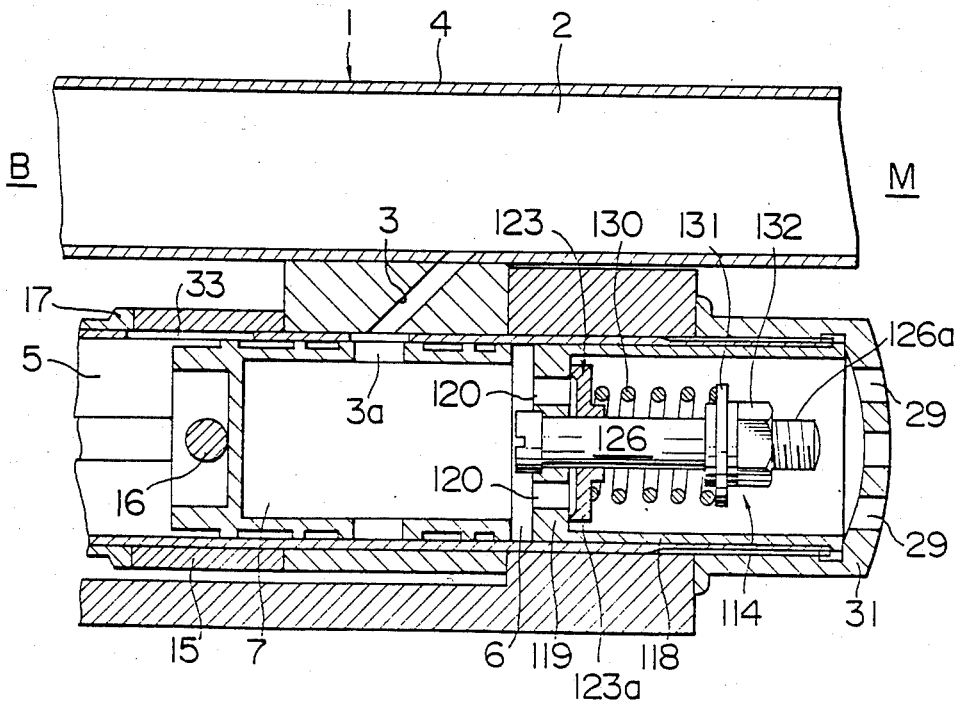
FIG. 6 PRIOR ART
FIG. 6 is an elevational view similar to FIG. 1 showing an example of a gas pressure adjusting device of the prior art.

The aforementioned gas-operated mechanism of the prior art shown in FIG.6 has a pressure-adjusting valve assembly 114 having the following construction and arrangement. The outer structure of this valve assembly is a cylindrical valve housing 118 having an open end on its muzzle side M and an opposite end on its butt side B closed by a circular partition wall 119. This valve housing 118 is closely fitted in the front or muzzle end part of the tube magazine 5, the partition wall 119 dividing the cylinder 6 into two sections. The partition wall 119 at its center supports a guide rod 126 in the form of a bolt, with a head and adjacent shank part, imbeddedly fixed to the wall 119 and extending through a central through hole thereof toward the muzzle side M.

A plurality of valve ports or openings 120, constituting gas discharge holes, extend through the wall 119 in a manner to surround the guide rod 126. These valve openings 120 can be closed or opened by a valve body 123 in the form of a disk having a peripheral sealing part 123*a* that is flange shaped. This valve body 123 is slidably and coaxially fitted on the guide rod 126 at a position immediateley forward of the wall 119. A compression coil spring 130 is disposed around the guide rod 126 and between the front face of the valve body 123 and the rear face of a washer or spring retainer 131, which is held in place relative to the guide rod 126 by a nut 132 screwed onto a threaded front end part 126*a* of the guide rod 126. The spring 130 is continually in compressed state, whereby the sealing part 123*a* of the valve body 123 is normally in sealing contact with the partition wall 119, thereby closing the valve openings 120.

As is apparent from FIG. 6, this known device is so adapted that the entire rear surface of the valve body 123 is exposed to gas pressure, that is, its pressure receiving area is large. Therefore, even under a relatively low pressure caused by a low-base load, the valve body 123 is thrust forward, compressing the spring 130 and tending to open the valve openings 120. In order to prevent this, a spring 130 of a great spring coefficient (and therefore of a large wire diameter) becomes necessary. In an instance of our previous practice, a spring load of 27.5 kg was necessary. Since the mass of the valve body 123 itself becomes large, and, in addition, the mass of the spring 130 also becomes large, the desired conditions (2) and (3) set forth hereinbefore cannot be satisfied.

Furthermore, because of the existence of the guide rod 126 in an imbedded state in the center of the partition wall 119, the great spring pressure, and the gas pressure at the time of firing, the mechanical strength of the partition wall 119 having the valve openings 120 presents a problem in that only a limited number of these openings 120 can be formed. Consequently, the total cross-sectional area of the valve openings 120 cannot be made large, whereby the aforestated condition (4) also cannot be fully satisfied. The known device shown in FIG. 6, moreoever, is accompanied not only by the above described problems but also by a great difficulty in assembling because of the large spring load. Furthermore, only a slight change in the screw-engagement position of the nut 132 causes an appreciable variation in the spring load, whereby problems such as irregular deviations in the product items occur.

As is apparent from its accompanying drawings, the aforementioned U.S. Pat. No. 3,020,807, except for the desired condition (4) set forth hereinbefore, does not solve the problem of the known device shown in FIG. 6. While the device of U.S. Pat. No. 3,127,812 can be considered to be operable with a relatively small spring load, it has very small valve openings, which appears to be a serious deficiency. Furthermore, it is doubtful whether or not the closure of valve openings in an opened state can be accomplished positively, whereby operational reliability is a problem.

The above described problems of known devices have been overcome in the device of the the present invention, which will now be described with respect to a preferred embodiment thereof and a of the preferred embodiment.

Figure 1:
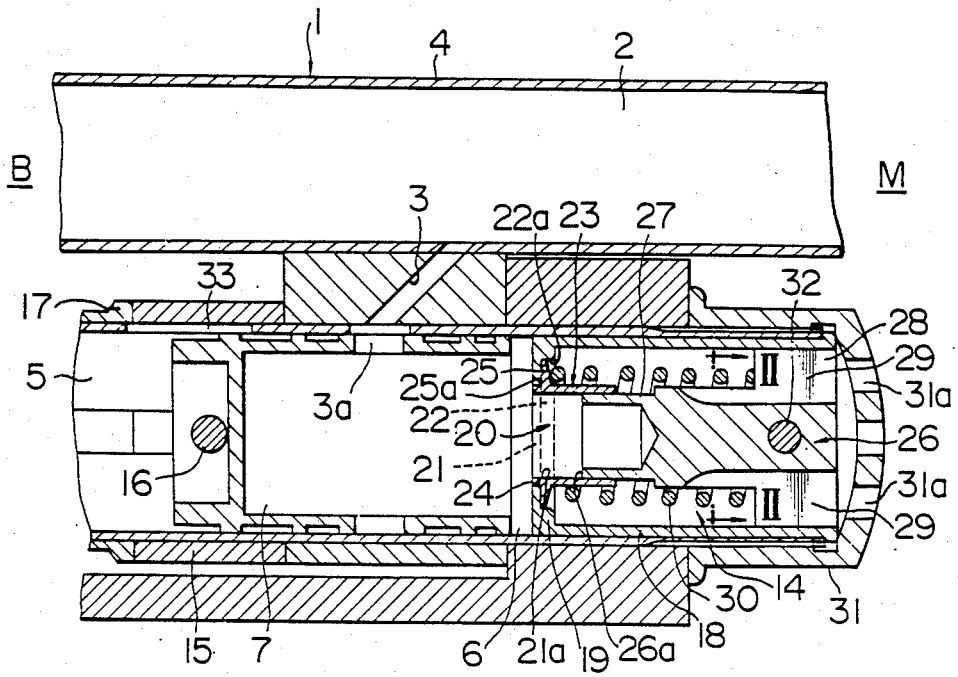
FIG. 1 is a right side elevational view in vertical section, showing an example of the gas pressure adjusting device, according to the present invention, in an installed state in the gas operated mechanism of a shotgun, the valve body thereof being in a closed state against the valve seat.

In the preferred embodiment of this invention as shown in FIG. 1, the constructional arrangement of the cylinder 6, the piston 7 slidably fitted therein, the connecting ring 15 pin connected by the 16 to the piston 7, the sleeve 17 abuttingly contacting the connecting ring 15, and the slider 9 through which the sleeve 17 is coupled to the breech bolt 10 in the gas-operated mechanism is essentially the same as those described hereinbefore with reference to FIGS. 4 and 6.

The pressure regulating valve assembly 14 according to this invention has a valve housing 18 having a fully open end on its front or muzzle side M and a partition wall 19 integrally formed at its rear end on the butt side B. The partition wall 19 is in the shape of an annular ring, having a large central valve opening 20, which has a relatively smaller diameter part 21 on its rear side defining the valve opening 20 and a relatively larger diameter part 22 at its front side. The inner surface of the larger diameter part 22 is a sliding-contact surface 22*a*, the length of which in the longitudinal or axial direction of the valve assembly 14 is set at a value somewhat greater than that of the inner surface of the smaller diameter part 21 constituting a sliding-contact surface 21*a*.

Figure 3:
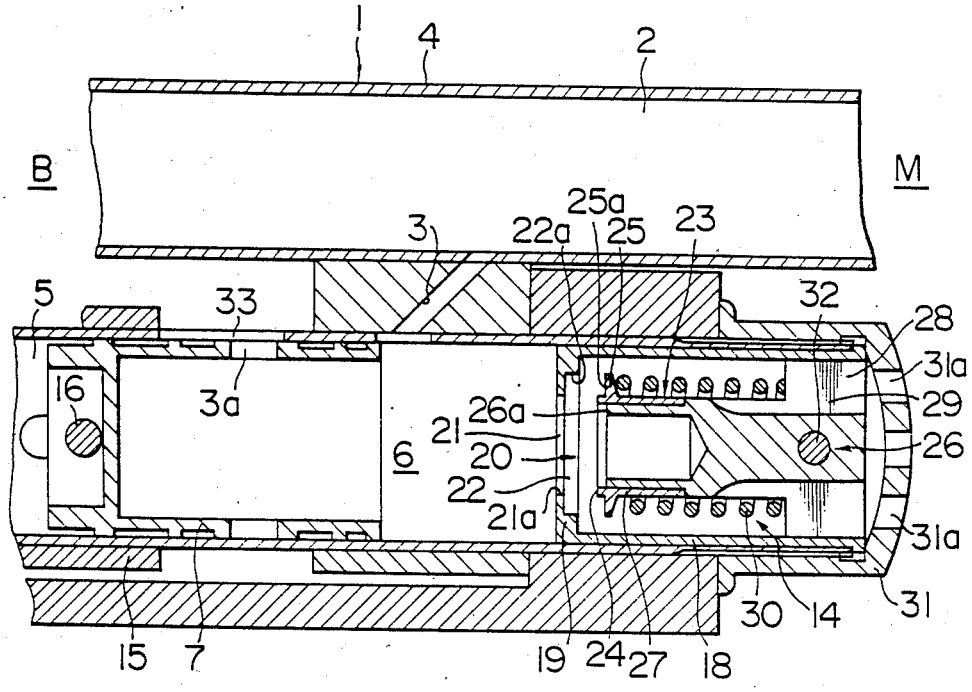
FIG. 3 is an elevational view similar to FIG. 1 of the present invention in a state wherein the pressure adjusting the valve is opened.

The valve opening 20 is closed and opened by a valve body 23 having a hollow cylindrical shape. An annular flange 25 is formed integrally therewith and extends radially outward at a part of the valve body 23 near the rear end thereof. The extreme rear end surface of this valve body 23 constitutes a first pressure-receiving surface 24, and the rear surface of the flange 25 constitutes a second pressure-receiving surface 25*a*. As will be apparent from FIGS. 1 and 3, the first pressure-receiving surface 24 has a relatively small diameter, and its pressure-receiving area is relatively small; while the second pressure-receiving surface 25*a* has a relatively large diameter, and its pressure-receiving area is relatively large. The relative dimensions of these parts are designed so that the outer periphery of the first pressure-receiving surface 24 fits within the sliding-contact surface 21*a* of the smaller diameter part 21 of the valve opening 20, and so that the outer periphery of the second pressure-receiving surface 25a fits within the sliding-contact surface 22*a* of the larger diameter part 22, and so that, moreover, the first pressure-receiving surface 24 lies substantially in the same plane as the rear surface of the partition wall 19 when the valve is closed.

Figure 2:
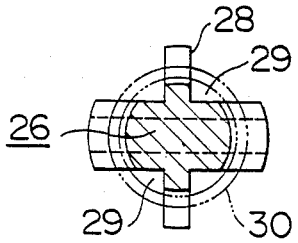
FIG. 2 is a section taken along the plane indicated by line II—II in FIG. 1 as viewed in the direction of the arrows.

The valve body 23 is slideably fitted on the outer fitting surface 27 of the rear end part of a guide rod 26 having a head part 28 at its front end. A plurality of cutouts are provided in the head part 28 as shown in FIG. 2 to form gas passageways 29 extending forward to communicate with the outside air. The head part 28 is fixed to the valve housing 18 by a pin 32 in a position such that the rear end surface 26*a* of the guide rod 26 confronts the valve opening 20 with a suitable spacing therebetween. A compression coil spring 30 is disposed around the valve body 23 and a part of the guide rod 26 and abuts at its rear end against the front face of the flange 25 and at its front end against the rear face of the head part 28.

The coil spring 30 is thus compressed, and the valve body 23 is urged rearward by the resulting spring force and is pressed against the rim part of the partition wall 19 constituting a valve seat around the valve opening 20, which is thereby closed by both the valve body 23 and the rear end surface 26*a* of the guide rod 26. Since the pressure receiving area of the first pressure-receiving surface 24 is relatively small, the valve body 23 will not be actuated in the opening direction by the gas pressure due to a low-base load even if the spring load of the spring 30 acting on the valve body 23 is set at a value of the order of one third of the spring load of the known device illustrated in FIG. 6 and described hereinbefore.

The valve housing 18 in which the guide rod 26 and the valve body 23 are installed as described above is fitted into the front end part of the tube magazine 5, and, similarly as in known shotguns, a fore-end cap 31 is screwed onto this front end part. The fore-end cap 31 is provided with a pluralty of gas passage holes 31*a*.

In the gas-operated mechanism of the above described constructional arrangement wherein the pressure-adjusting valve assembly 14 is installed in the forward end of the cylinder 6, the cylinder 6 is partitioned by the partition wall 19, and, in the normal state between firings of the mechanism, the valve opening 20 is closed by the valve body 23, whereby communication of the interior of the cylinder 6 with the outside air is shut off.

When a shotshell is fired, and its shot load or slug passes by the gas port 3, a portion of the gas generated by the firing and expanding within the bore 2 is introduced through the gas port 3 into the cylinder 6. As a consequence, gas pressure acts on both the piston 7 and the first pressure-receiving surface 24 of the valve body 23. In the case where the shotshell is of the low-base load type, the force due to the gas acting on the valve body 23 is not sufficient to move the valve body 23 forward against the spring force of the spring 30 since the gas pressure in this case is relatively low and also because the pressure receiving area of the first pressure-receiving surface 24 is small.

Consequently, only the piston 7 is forced rearward to bring about the recoiling action of the breech bolt as described hereinbefore. When the piston 7 thus thrust rearward reaches a position where gas ports 3*a* formed through its cylindrical wall coincide with a discharge opening 33 formed through the tube magazine 5, the gas within the cylinder 6 and the piston 7 is discharged, whereby the rearward motion of the piston 7 stops. Upon completion of the recoil action, the breech bolt 10 is pushed forward by the recoil spring 12 and undergoes its counter recoil motion, and the piston 7 is also forced forward by the sleeve 17 by way of the connecting ring 15 whereby the piston 7 returns to its original normal position.

When the load is changed from a low-base load to a high-base load, the firing gas pressure rises, and the forwardly pushing force generated by the gas acting on the first pressure-receiving surface 24 becomes greater than the rearwardly pushing force of the spring 30. As a consequence, the valve body 23 advances forward as it compresses, the spring 30, and the first pressure-receiving surface 24 separates away from the sliding-contact surface 21*a* of the small diameter part 21 of the valve opening 20, whereby the small diameter part 21 is opened. However, since the outer periphery of the second pressure-receiving surface 25*a* is fitted within the sliding-contact surface 22*a* of the large diameter part 22, the valve opening 20 is still closed.

When the small diameter part 21 is thus opened, the gas pressure, which has hitherto been acting on only the first pressure-receiving surface 24, now also acts on the second pressure-receiving surface 25*a* having a wide pressure-receiving area, the valve body 23 thereby being acted upon by the gas pressure on both the first and second presure-receiving surfaces 24 and 25*a*. Thus, the valve body 23, under a very great forward force, advances at an extremely high velocity (FIG. 3), opening the valve opening 20, whereby the surplus gas within the cylinder 6 is instantaneously discharged through the gas passageways 29 and gas passage holes 31*a* into the outside air. As a result, the gas pressure within the cylinder 6 is adjusted, whereby the piston 7 is forced rearward by a suitable gas pressure, and there is no possibility of any moving part being subjected to excessive impact.

The valve body 23 which has advanced forward returns to its former state when the balance between the force due to the gas pressure within the cylinder 6 and the force of the spring 30 is broken. The valve body 23 is thereby pressed against the partition wall 19 to close the valve opening 20. The time period between the opening and closing of the valve opening in the above described manner, that is, the magnitude of the quantity of the gas discharge, varies automatically with the magnitude of the gas pressure within the cylinder 6, whereby the gas operated mechanism is amply adaptable to variations over gas pressure of a broad range from a low-base load to a high-base load. The piston 7 which has been forced rearward, of course, returns to its initial forward position similarly as in a conventional shotgun.

Of the shotshells in general use at the present time, the 3-inch magnum generates the highest gas pressure. In order to fire this shotshell, a special barrel exclusively for the use thereof and separate from the aforementioned 2¾-inch shotshell barrel is necessary. A shotgun with such a special barrel is adapted to restrict the quantity of gas introduced into the cylinder 6 so as to prevent the imparting of excessive firing impact to the moving parts of the shotgun. When a 3-inch magnum shotshell is fired by the use of the special barrel, the time period required from the instant of percussion to completion of recoil of the breech bolt 10 is of the order of 0.02 seconds according to our actual measurements.

In comparison, when a 2¾-inch shotshell is fired from a 2¾-inch shotshell barrel of an automatic shotgun equipped with the pressure-adjusting valve 14 described above of the invention, this recoil time is somewhat longer than 0.02 second in the case of a high-base load and is of the order of 0.03 second in the case of low-base load. Thus, by the use of the device of this invention, the gas pressure is adjusted so that the recoil velocity becomes less than that in the case of a 3-inch magnum shotshell and its shotgun even in the case when a high-base load shotshell is fired. Therefore, the imparting of excessive firing impact to the moving parts of the shotgun including the breech bolt is prevented. Furthermore, when a low-base shotshell is fired in the same shotgun, malfunctioning does not occur.

While, in the foregoing disclosure, the present invention has been described with respect to only an example thereof wherein the adjusting valve assembly 14 is installed entirely within the valve housing 18, the practice of this invention is not so limited. That is, for example, the partition wall 19 having the valve opening 20 formed therethrough and the guide rod 26 may be installed directly within the tube magazine 5.

Furthermore, the pressing contact between the valve body 23 and the rim surfaces of the valve opening 20 need not be limited to the structure and arrangement described above. That is, the valve assembly may take any appropriate form provided that it affords a valve, starting from a state in which the valve opening 20 is normally closed by both the valve body 23 and the guide rod 26, wherein at: first, when only the first pressure-receiving surface 24 is subjected to the action of a gas pressure exceeding a predetermined pressure, the valve body 23 advances forward; and wherein secondly, the second pressure-receiving surface 25*a* is exposed to the gas pressure as a consequence of this forward advance and wherein finally the valve body advances forwardly to fully open the valve opening 20.

Figure 5:
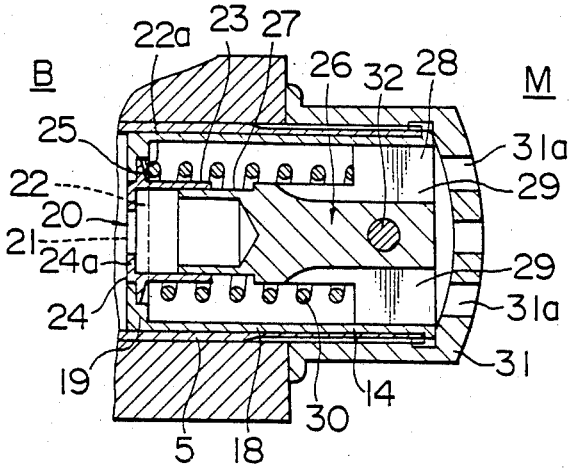
FIG. 5 is a partial right side elevational view, in vertical section, showing another example of the device of the present invention.

In still another modification as shown in FIG. 5, the valve body 23 having a hollow cylindrical shape has a rear end wall which has a central opening and an annular inwardly projecting rim 24a, the rear surface of which constitutes the first pressure-receiving surface 24. By this constructional arrangement, the response of the mechanism is advanced in the case of low gas pressure.

As will have been apparent from the foregoing disclosure, the gas pressure adjusting device according to this invention adjusts, in a substantially stepless action, the gas pressure within the actuating cylinder of a gas-operated automatically-loading shotgun in accordance with the magnitude of the gas pressure within the entire range of shotshell loads from low-base to high-base loads, thereby preventing malfunctioning of the gas-operated mechanism when a low-base load shotshell is fired and preventing the imparting of excessive impact to the moving parts including the breech bolt when a high-base load shotshell is fired. Thus, all of the conditions desired of a pressure adjusting valve of the instant type as set forth hereinbefore are satisfied. Furthermore, as is apparent from the drawings, the device of this invention has a simple construction, whereby it is relatively free of mechanical trouble, and the maintenance thereof is facilitated. An additional advantageous feature of this device is that it can be readily installed in an existing automatic shotgun with only a simple adaptation.

What is claimed is:

1. A pressure adjusting valve assembly for a gas-operated auto-loading firearm having a gas operated mechanism which is actuated by gas pressure generated in a barrel of the firearm during firing thereof, the gas pressure being introduced into an actuating cylinder to drive a piston rearward therein which in turn actuates a breech bolt for facilitating the automatic operation of the firearm, said pressure adjusting valve assembly comprising:

a partition wall confronting the piston and defining a front end of the cylinder, said partition wall having a valve opening extending therethrough, said valve opening comprising a first opening extending a predetermined distance through one end of said partition wall which confronts said piston, said first opening having a first relatively small diameter, and a second opening open to and continuous with said first opening and extending a second predetermined distance through the other side of said partition wall, said second predetermined distance being greater than said first predetermined distance, said second opening having a relatively large diameter that is larger than said relatively small diameter of said first opening, the portion of said partition wall surrounding said valve opening being a valve seat; and a valve body seated on said valve seat, and spring means connected to said valve body for urging said valve body against said valve seat whereat said valve body closes said valve opening, said valve opening open to and comunicating with the atmosphere when said valve body is in an open position with respect to said valve opening, said valve body having a rear end portion extending within said first opening and in sliding engagement with the portion of said partition wall surrounding said first opening, said rear end portion having a first pressure-receiving surface exposed at said one side of said partition wall, and a front end portion extending within said second opening and in sliding engagement with the portion of said partition wall surrounding said second opening, said front end portion having a second pressure receiving surface that faces said first opening, the gas pressure introduced into the actuating cylinder acting on said first pressure receiving surface to slide said rear end portion of said valve seat over said first predetermined distance and out of said first opening when the gas pressure exceeds a predetermined amount which overcomes a force exerted by said spring means after which the gas pressure then acts on said first pressure receiving surface and said second pressure receiving surface to abruptly slide said front end portion of said valve seat out of said second opening to place said valve body in said open position to vent the gas pressure exceeding said predetermined amount to the atmosphere, whereby when relatively low gas pressure that is less than said predetermined amount is introduced into the actuating cylinder during firing of a low-base load shell,said rear end portion is not slid out of said first opening and the relatively low gas pressure sufficiently drives the piston to actuate the breech bolt, and when relatively high gas pressure that exceeds said predetermined amount is introduced into the actuating cylinder during firing of a high-base load shell, said valve body is abruptly moved to said open position to abruptly vent the gas pressure exceeding said predetermined amount to the atmosphere for preventing parts of the firearm that are moved by the gas pressure exceeding said predetermined amount from exerting an excessive impact force.

2. A pressure adjusting valve assembly as claimed in claim 1, and further comprising a guide rod fixed relative to the actuating cylinder confronting aid other side of said partition wall that is coaxial with respect to said valve opening; and wherein said valve body has a generally hollow cylindrical shape, one end of said cylindrical valve body being seated on said valve seat, said guide rod extending at one end thereof into the other end of said cylindrical valve body for guiding said cylindrical valve body when said cylindrical valve body slides relative to said valve seat.

3. A pressure adjusting valve assembly as claimed in claim 2, wherein said end pressure receiving surface of said rear end portion is an annular rim extending within the periphery of said cylindrical valve body at said one end thereof.

4. A pressure adjusting valve assembly as claimed in claim 1, and further comprising a valve housing in which said valve body is slidably mounted, said partition wall being on end of said valve housing that confronts said piston, said valve housing having at least one gas passage hole extending therethrough open to and communicating with the atmosphere.

* * * * *

UNITED STATES PATENT AND TRADEMARK OFFICE

CERTIFICATE OF CORRECTION

PATENT NO. : 4,702,146

DATED : October 27, 1987

INVENTOR(S) : Kouhei IKEDA et al.

It is certified that error appears in the above-identified patent and that said Letters Patent is hereby corrected as shown below:

In claim 1, lines 47 and 52, "valve seat" has been changed to --valve body--.

Signed and Sealed this

Twenty-ninth Day of November, 1988

*Attest:*

*Attesting Officer*

DONALD J. QUIGG

*Commissioner of Patents and Trademarks*